US006018115A

United States Patent [19]

Leonard

[11] Patent Number: 6,018,115

[45] Date of Patent: Jan. 25, 2000

[54] LOW FRICTION VENTED ROTARY VALVE FOR BRASS WIND INSTRUMENTS

[76] Inventor: Brian P. Leonard, 1849 Brookfield Dr., Akron, Ohio 44313

[21] Appl. No.: 09/337,118

[22] Filed: Jun. 21, 1999

Related U.S. Application Data

[60] Provisional application No. 60/124,651, Mar. 16, 1999.

[51] Int. Cl.[7] ..... G10D 9/04

[52] U.S. Cl. ..... 84/390; 84/387 R

[58] Field of Search ..... 84/387 R, 388, 84/389, 390, 391, 392, 393, 394, 395, 396

[56] References Cited

U.S. PATENT DOCUMENTS

| | | | |
|---|---|---|---|
| 74,331 | 2/1868 | Fiske | 84/387 R |
| 530,781 | 12/1894 | Leleand | 84/395 |
| 1,729,568 | 9/1929 | Couturier | 84/387 R |
| 1,764,562 | 6/1930 | Gulick | 84/387 R |
| 2,672,783 | 3/1954 | Kaufer | 84/387 R |
| 4,095,504 | 6/1978 | Hirsbrunner | 84/390 |
| 5,361,668 | 11/1994 | Andersen et al. | 84/392 |
| 5,686,678 | 11/1997 | Greenhoe | 84/390 |
| 5,900,563 | 5/1999 | Leonard | 84/390 |

FOREIGN PATENT DOCUMENTS

| | | |
|---|---|---|
| 135643 | 4/1985 | European Pat. Off. . |
| 212540 | 8/1909 | Germany . |
| 220741 | 4/1910 | Germany . |
| 4400215 | 1/1994 | Germany . |
| 1280798 | 10/1989 | Japan . |

*Primary Examiner*—Robert E. Nappi
*Assistant Examiner*—Wesley Scott Ashton
*Attorney, Agent, or Firm*—Renner, Kenner, Greive, Bobak, Taylor & Weber

[57] ABSTRACT

A low friction vented rotary valve for a brass instrument is disclosed comprising a partially circumferential member providing a low friction engagement with the rotary casing. The partially circumferential member has first, second and third apertures therein with a first tube connected between the first and second apertures and a second tube connected at one end of the circumferential member. The second tube has an arcuate collar at its other end for providing another low frictional surface engaging the rotor casing.

18 Claims, 7 Drawing Sheets

FIG.-12
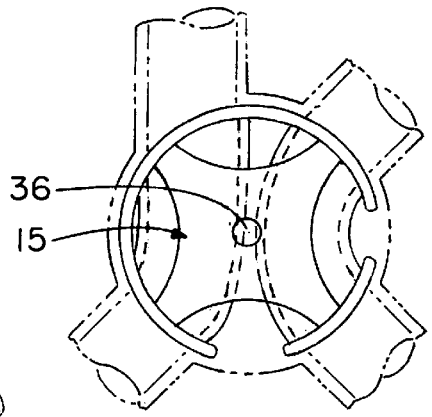
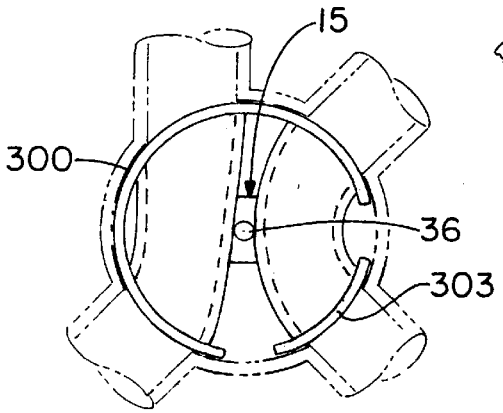
FIG.-12A
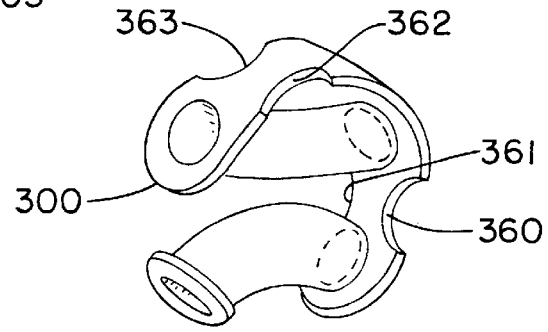
FIG.-13
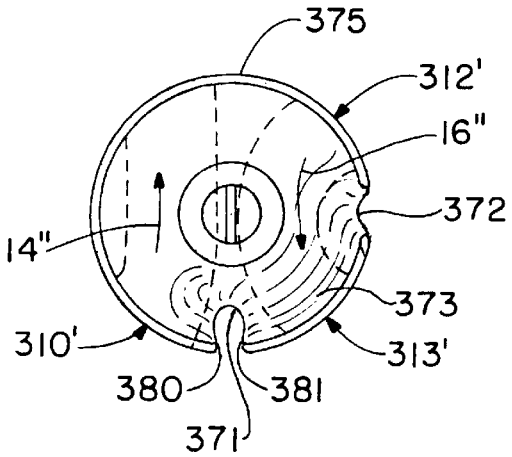
FIG.-14
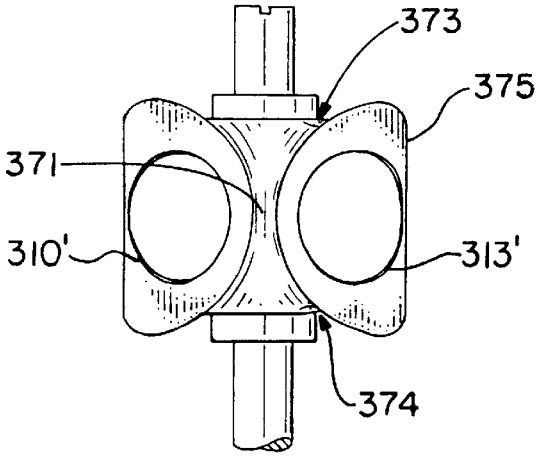
FIG.-15

LOW FRICTION VENTED ROTARY VALVE FOR BRASS WIND INSTRUMENTS

This application gains priority from Provisional Patent Application No. 60/124,651 filed on Mar. 16, 1999.

TECHNICAL FIELD

The present invention relates generally to musical instruments. More particularly, the present invention relates to valves for brass wind instruments. Specifically, the present invention relates to rotary valves for brass wind instruments.

BACKGROUND OF THE INVENTION

Brass instruments such as French horns, trombones, tubas, trumpets, and the like, typically include a flared bell connected to a mouthpiece by at least one length of hollow tubing. The tone of the sound produced by the instrument depends, in part, on the length of the tubing connecting the mouthpiece to the bell. Thus, the tone of the sound produced by the musical instrument may be changed by altering the length of the tubing between the bell and the mouthpiece. With the exception of the slide trombone, the addition of tubing length is accomplished by adding loops of tubing that may be selectively activated by use of valves. There are several types of valves used on brass instruments, the most common being piston valves and rotary valves of varying specific designs.

A slide trombone typically includes a mouthpiece that is connected to a bell with tubing having an adjustable sliding section referred to as a handslide. The handslide permits the musician to selectively and continuously vary the length of the connecting tubing while he plays the instrument. To create a tone having lower pitch, the musician increases the length of the tube by pushing the handslide away from himself. Conversely, the musician pulls the handslide back to decrease the length of the tubing creating a higher pitch tone. Musical pieces that require rapid changes between high notes and low notes are more difficult to play because of the required rapid, and accurate, manipulation of the handslide over relatively large distances. To decrease the distances between notes, additional sections of tubing may be added to the instrument and to extend the low register range. The additional loops are selectively incorporated into the active length of tubing by one or more valves, use in conjunction with the handslide.

Rotary valves are among the numerous types of valves used to add and subtract the additional loops into and out of the active length of tubing. Rotary valves generally include a rotor that may be selectively rotated inside a casing. Two or more air ducts are typically disposed in the rotor. The tubes of the instrument are connected to the casing such that the air ducts inside the rotor may selectively form different soundpath configurations for the instrument. A soundpath is defined by the configuration of the tubing of the instrument. One undesirable aspect of known rotary valves is that the cross-section of the tubing does not remain constant through the valve, thus increasing the acoustic impedance of the instrument.

Acoustic impedance degrades the quality of the musical tones produced by the musical instrument by adversely affecting the sound waves as they pass through the instrument. Acoustic impedance generally increases as the length of the tubing used to produce the sound increases. The surface and shape of the tubing also affects acoustic impedance. Generally, the level of acoustic impedance increases as the number of serpentine turns in the tubing increases and as the radii of the turns decrease. Transitions between tubing sections of different cross-sections or diameter are another factor that increases the acoustic impedance. Abrupt or sharp transitions generally have a higher level of impedance than smooth transitions.

One rotary valve disclosing a duct configuration having variable tubing cross-sections is disclosed by U.S. Pat. No. 4,095,504 to Hirsbrunner. Each passageway through the rotor of the valve is generally D-shaped in cross-section while the tubing of the instrument is circular in cross-section. Furthermore, the connections between the rotor ducts and the duct connectors are not smooth and undesirably restrict airflow therethrough. The soundpaths created by the valve exhibit the undesirable sharp transitions, non-constant cross-sections, and tight turns that increase acoustic impedance.

One valve that solves the problems of tight turns and abrupt transitions is disclosed by U.S. Pat. No. 5,361,668 to Andersen et al. The Andersen valve includes a rotor having three passageways therethrough. Two of these passageways are straight while the third is in the shape of a flattened 'S'. The Andersen valve affords "straight through" airflow when the valve is in the position where it adds the extra length of tubing. The "straight through" airflow design creates less resistance for the musician while he plays low notes. A problem with the Andersen valve is that the third passageway used to accomplish the "straight through" design causes the overall dimensions of the valve to be too large to be favored by musicians and instrument designers. One limitation of the Andersen valve is that it is specifically designed for a trombone with one or two attachments. Its relatively large physical size makes it too cumbersome to be used on other brass instruments such as French horns, euphoniums, tubas, and the like.

Another problem with some rotary valves is the occurrence of a noticeable sound made as a valve passes back and forth between its actuated and unactuated piston. This unacceptable "air click" is caused by air-flow blockage and concurrent pressure change or release as the rotor passes through the half-valve position. The subsequent sudden pressure release as the ducts align with the external tubing causes an audible "sucking-click" sound ("ffft") which is amplified in the bell of the instrument.

U.S. Pat. No. 5,686,678 to Greenhoe discloses a valve that attempts to alleviate the sudden pressure release as the ducts move from the unactuated to the actuated position. Greenhoe discloses a cylindrical shell rotor with vent openings 51 and 54 machined into the sides of the cylindrical shell. These holes provide some relief from air pressure build up. But, the complete cylindrical shell walls that surround the machined holes impede the vented air flow. Furthermore, Greenhoe discloses a symmetrical 90 degree bend in both passageways. Two 90 degree bends create unwanted impedance of the air flow as it passes through the valve. Furthermore, Greenhoe does not address problems associated with friction that exists between the rotor and the casing.

SUMMARY OF THE INVENTION

It is, therefore, an object of the present invention to provide a rotary valve that conforms to traditional, compact rotary valve geometry.

It is another object of the present invention to provide a rotary valve, as above, having constant-diameter circular cross-section soundpaths.

It is a further object of the present invention to provide a rotary valve, as above, wherein the soundpaths through the valve have minimal curvature for limiting the acoustic impedance.

It is still another object of the present invention to provide a rotary valve, as above, having overall dimensions generally compatible with conventional tubing configurations.

It is yet another object of the present invention to provide a rotary valve, as above, providing minimal air flow resistance at all rotor orientations within the working range.

It is still a further object of the present invention to provide a rotary valve, as above, that accomplishes the objects of the invention with a rotor having only two ducts.

It is another object of the present invention to provide a rotary valve, as above, that may be incorporated into a variety of different brass instruments.

It is yet another object of the present invention to provide a rotary valve, as above, wherein a plurality of valves may be attached in series to permit multiple attachments having smooth airflow passages.

With respect to certain embodiments of the present invention, it is also an object to provide a light-weight rotor that, due to its smaller rotational inertia, will provide faster rotation speeds.

Also, with respect to certain embodiments of this invention, it is an object to provide a rotor that has less contact surface area with the casing to minimize friction and thereby provide faster rotation speeds.

Still further, and with specific reference to certain embodiments of this invention, it is an object to provide a rotor that provides a venting path for air to travel and thereby alleviate unwanted noise due to pressure buildup and release that is associated with rotating the rotor from the actuated to the unactuated position or vice versa.

These and other objects of the invention, as well as the advantages thereof over existing and prior art forms, shall become apparent in view of the following detailed specification, and are accomplished by means hereinafter described and claimed.

In general the present invention provides a rotor for a brass wind instrument comprising a partially circumferential member having first, second and third apertures therein, a first tube connected between the first and second apertures, a second tube connected at one end to the circumferential member and having an arcuate collar at the other end, the collar positioned on the same circumference as the circumferential member.

The present invention also provides a rotary valve for a brass wind instrument comprising a casing, a rotor rotatably disposed in the casing, the rotor comprising a partially circumferential member having first, second and third apertures therein, a first tube connected between the first and second apertures, a second tube connected at one end to the circumferential member and having an arcuate collar at the other end, the collar positioned on the same circumference as the circumferential member.

The present invention further provides a rotor for a brass wind instrument comprising a rotor body, the rotor body having first and second ducts, where each duct has a constant circular cross-section, and the rotor body also including a scavenged vent path around the second duct, where the scavenged vent path forms a collar around an aperture formed by the second duct.

BRIEF DESCRIPTION OF THE DRAWINGS

FIG. 12 is a plan view of another embodiment of the rotary valve according to the present invention, illustrating a rotor support member.

FIG. 13 is an isometrical view of an embodiment of this invention where a partial circumferential member includes scallops.

FIG. 14 is a plan view of another embodiment of this invention where the rotor is a solid body having air passageways therethrough.

FIG. 15 is a side view of the embodiment shown in FIG. 14.

DESCRIPTION OF AN EXEMPLARY EMBODIMENT

Figure 1:
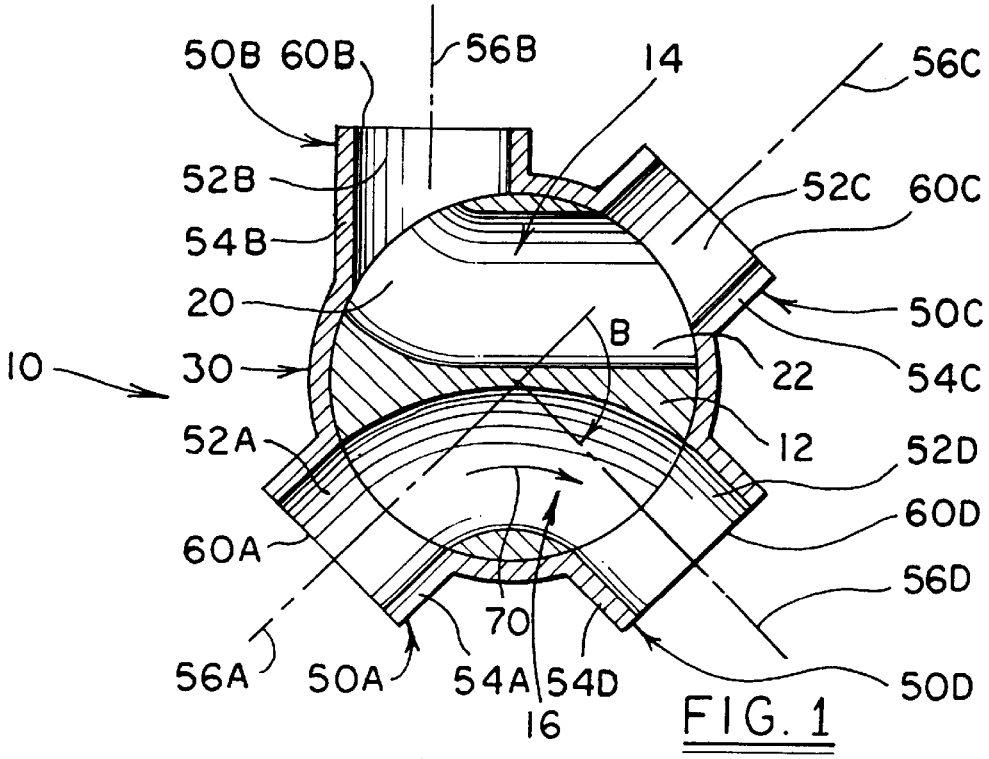
FIG 1 is a cross-sectional side view of the rotary valve according to the present invention, the valve being depicted in the unactuated position.
Figure 3:
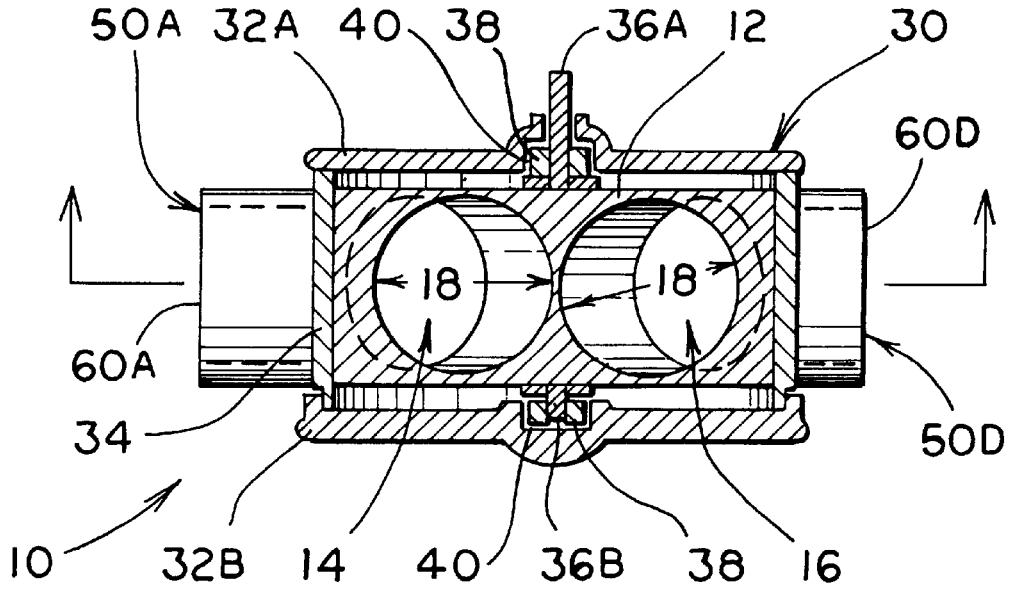
FIG. 3 is a cross-sectional plan view of the rotary valve taken substantially along line 3—3 of FIG. 2, the valve being in the actuated position.

One representative form of a rotary valve according to the present invention is designated generally by the numeral 10 on the accompanying drawings. The valve 10 includes a rotor 12 having a first duct 14 and a second duct 16 passing therethrough. Each duct 14 and 16 has a constant, circular cross-section having a diameter indicated by the numeral 18. The first duct 14 has a curved portion 20 that turns the duct 14 approximately 45 degrees, as indicated by the letter A on the drawings, and connects smoothly with a straight portion 22. As the skilled artisan will appreciate, a turned soundpath of less than 45 degrees will not diminish the sound quality. As the angle of the turn in duct 14 is increased toward 90 degrees, however, at some indeterminable point a skilled musician can perceive a diminishment in sound quality. An angle of 70 degrees probably can be distinguished from angle of approximately 45 degrees, but 55 degrees probably cannot. Accordingly, by approximately 45 degrees, it is meant that the angle of the turn in duct 14 can vary to an extent that a distortion in sound quality can not be noticed by the skilled musician. Preferably, the angle should not exceed about 70 degrees, more preferably, it should not exceed about 60 degrees, and even more preferably, it should not exceed about 50 degrees. The second duct 16 is continuously curved and turns substantially 90 degrees, as shown in FIGS. 1 and 3, this angle is indicated by the letter B on the drawings. By substantially 90 degrees or an angle of substantially 90 degrees, it is meant that the angle will be exactly 90 degrees or vary within small manufacturing tolerances.

The rotor 12 is rotatably disposed in a generally cylindrical casing 30. The casing 30 includes generally disk-shaped first end wall 32A and second end wall 32B, connected to a generally cylindrical sidewall 34. The rotor 12 is connected to a first pin 36A and a second pin 36B. The pins 36 are located on a common central axis about which the rotor 12 may be selectively rotated. The mechanism for selectively rotating the rotor 12 may be one of the many that are known in the art and thus is not specifically described in this specification. Each pin 36 may rest directly against the end walls 32, or may rotate against suitable bearings 38 as shown in FIG. 3. Each end wall 32 has a cavity 40 disposed therein configured to accept the bearings 38.

As may be observed in the previous paragraph, a particular structural member, component or arrangement may be employed at more than one location. When referring generally to that type of structural member, component or arrangement, a common numerical designation shall be employed. However, when one of the structural members, components or arrangements so identified is to be individually identified, it shall be referenced by virtue of a letter suffix employed in combination with the numerical designation employed for general identification of that structural member, component or arrangement. Thus, there are at least two end walls which are generally identified by the numeral 32, but the specific, individual end walls are, therefore, identified as 32A and 32B in the specification and the drawings. This same suffix convention shall be employed throughout the specification.

Four tube connectors 50A–D are disposed about the circumference of the casing 30. The tube connectors 50 allow the valve 10 to be connected to the various tubes (not shown) of a brass instrument that are used to produce the sound. Each tube connector 50 is bonded to the casing 30 in a fluid-tight connection, such as a continuous weld. Each tube connector 50 has a passageway 52 therethrough, defined by the sidewall 54 of the connector 50. Each passageway 52 passes through the sidewall 34 of the casing 30 where the tube connectors 50 are connected to the casing. The casing 30 and the rotor 12 are each configured such that a fluid-tight connection is formed between a passageway 52 and a duct 14 or 16 when the rotor 12 is positioned to align a duct 14 or 16 with a passageway 52. Each passageway 52 has a constant, circular cross-section having the same diameter 18 as the ducts 14 and 16 in the rotor 12.

The configuration of the tube connectors 50 varies depending on the type of instrument in which the valve 10 is incorporated. In the embodiment of the present invention depicted in FIGS. 1–3, each tube connector 50 has a straight sidewall 54. The centerline 56A of the first tube connectors 50A forms a substantially 90 degree angle with the centerline 56D of the fourth tube connector 50D. Similarly, the centerline 56C of the third tube connector 50C forms a substantially 90 degree angle with the centerline 56D of the fourth tube connector 50D. Thus, the centerlines 56A and 56C of the first 50A and third 50C tube connectors are essentially parallel. The disposition of the tube connectors 50 remains the same even when tube connectors 150 having curved sidewalls 154 are used as shown in FIGS. 4–7.

Each tube connector 50 has a generally planar port 60 where the passageway 52 passes through the end of the tube connector 50. Each port 60 is essentially perpendicular to its respective centerline 56. Thus, the first port 60A is essentially parallel to the third port 60C and both the first 60A and third 60C ports are essentially perpendicular to the fourth port 60D. Furthermore, the second port 60B is essentially disposed at an approximately 45 degree angle to each of the other ports 60A, 60B and 60C. When the valve 10 is typically installed, the first 60A and third 60C ports function as inlet ports while the second 60B and fourth 60D ports function as outlet ports.

The valve 10 may be installed in a brass instrument such as a trombone. Tenor and alto trombones typically include a single valve while tenor-bass and bass trombones typically include two valves connected in series. FIGS. 4–7 illustrate a representative two valve arrangement, and its various actuated and unactuated combinations. Other instruments such as trumpets; alto, tenor, and baritone horns; French horns including single, double, and triple horns; euphoniums; and tubas typically include three valves. Other instruments may include four or five valves connected in series, as well as those having a stacked configuration. In all of these instruments, smooth air flow passages through the instrument are important in order to produce high quality tones.

In order to describe the operation of the valve 10, it will now be assumed that the valve 10 is installed such that the air and sound are traveling from the mouthpiece (not shown) and are entering the valve through the first port 60A. The fourth port 60D is assumed to be connected to a tube (also not shown) that leads to the bell (also not shown) of the instrument or to the entrance of another valve 110 as shown in FIGS. 4–7. The second port 60B is connected to an extension tube that provides additional tubing length to the instrument and connects back to the third port 60C.

The second duct 16 is configured, as described above, to connect the first passageway 52A with the fourth passageway 52D when the rotor 12 is in the unactuated position depicted in FIG. 1. The combination of the first passageway 52A with the second duct 16 and the fourth passageway 52D is referred to as the single soundpath 70 formed through the valve 10 in the unactuated position. The first duct 14, the second passageway 52B, and the third passageway 52C are not a part of the soundpath when the valve is in the unactuated position and thus do not have to be in alignment. Thus, in the unactuated position, sound enters the valve 10 from the first port 60A and exits through the fourth port 60D The continuously curved nature of the second duct 16 causes the sound to experience a single turn of substantially 90 degrees that does not seriously degrade the quality of the sound. The single soundpath 70 also has a constant circular cross-section and does not include any sharp edges or abrupt changes in diameter or volume.

Figure 2:
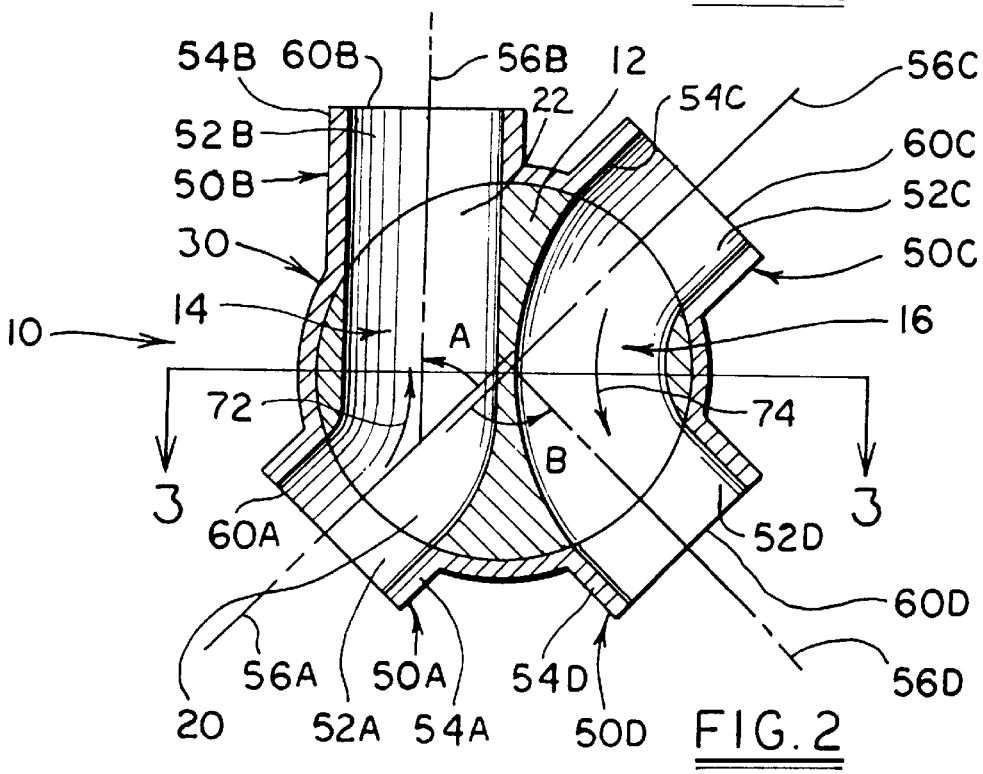
FIG. 2 is a cross-sectional side view of rotary valve according to the present invention, the valve being depicted in the actuated position.

In the actuated position, the valve 10 is designed to add an extension tube into the instrument's soundpath for the purpose of increasing the length of the column of air used to produce the sound. In the actuated position, the valve 10 forms two soundpaths 72 and 74 as shown in FIG. 2. The first actuated soundpath 72 is formed by the connection of the first passageway 52A with the second passageway 52B by the first duct 14. The first actuated soundpath 72 subjects the sound waves traveling therethrough to a single turn of approximately 45 degrees. Unlike some valves known in the art, the turn is smooth because of the continuous sidewalls. It is also common in known valves to turn the first actuated soundpath 90 degrees within the rotor. In some known valves, the first actuated soundpath completes a 180 degree turn. These configurations unnecessarily increase the acoustic impedance of the valve. The lack of unnecessary turns in the first actuated soundpath 72 and the constant tube diameters cause the valve 10 to have a lower acoustic impedance than it would have if the first actuated soundpath 72 turned the sound substantially 90 degrees.

The second duct 16, which is configured to form the single unactuated soundpath 70, is also configured to form the second actuated soundpath 74. The second actuated soundpath 74 is formed by the connection of the third passageway 52C and fourth passageway 52D with the second duct 16. The second actuated soundpath 74 subjects the sound to a single 90 degree turn within the rotor. As in the first actuated soundpath 72, the second actuated soundpath 74 is essentially continuous having no abrupt transitions, changes in diameter or tight turns.

When a musician is playing an instrument employing a valve 10 according to the present invention, the higher notes are played with the rotor 12 residing in the unactuated position. Thus, the sound produced travels through the single unactuated soundpath 70. When the musician desires to play lower notes, he actuates the valve 10 by triggering the appropriate mechanism to rotate the rotor 12 by approximately 90 degrees to the actuated position, thus forming the two actuated soundpaths 72 and 74. When the musician is playing the lower notes through the extra length of tubing, it is especially important to decrease the resistance of the valve felt by the musician because the extra length of tubing adds its own resistance. Thus, in addition to the constant diameter of soundpaths 72 and 74, the first actuated soundpath 72 has been straightened as much as possible, consistent with not interfering with the second duct 16.

Multiple valves 10 may be connected to provide an instrument with a wider range of tones. One such configuration of two connected rotary valves 110 and 210 is depicted in FIGS. 4–7. Each valve 110 and 210 includes essentially the same components as the valve 10 described above. The second tube connectors 150B and 250B have the same straight sidewall 154 and 254 as the valve 10 described above. However, the first, third and fourth tube connectors 150A, 150C, 150D, 250A, 250C and 250D in the connected valves 110 and 210 depicted in the drawings have curved sidewalls 154A, 154C, 154D, 254A, 254C and 254D. The curved sidewalls 154A, 154C, 154D, 254A, 254C and 254D allow the valves 110 and 210 to be located close to each other as is common in the art.

Figure 4:
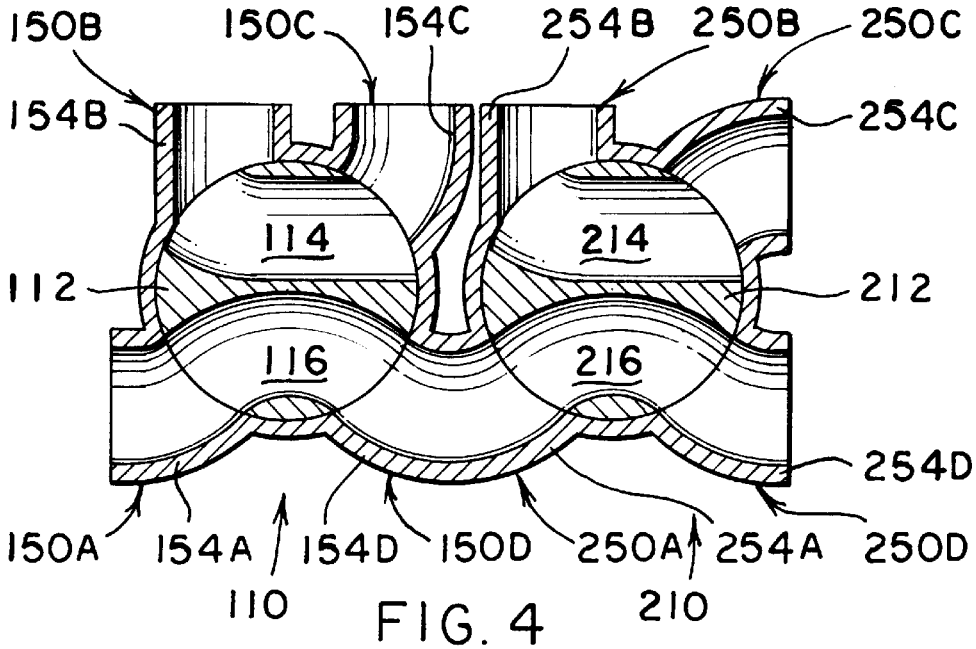
FIG. 4 is a cross-sectional side view of two rotary valves according to the present invention connected in series with the rotors of both valves in an unactuated position.

When both rotors 112 and 212 are in the unactuated position as shown in FIG. 4, no additional loops are included in the soundpath, and the sound passing through the valves 110 and 210 is only subjected to limited turning. Thus, the second duct 116 turns the sound substantially 90 degrees and the second duct 216 turns the sound substantially 90 degrees.

Figure 5:
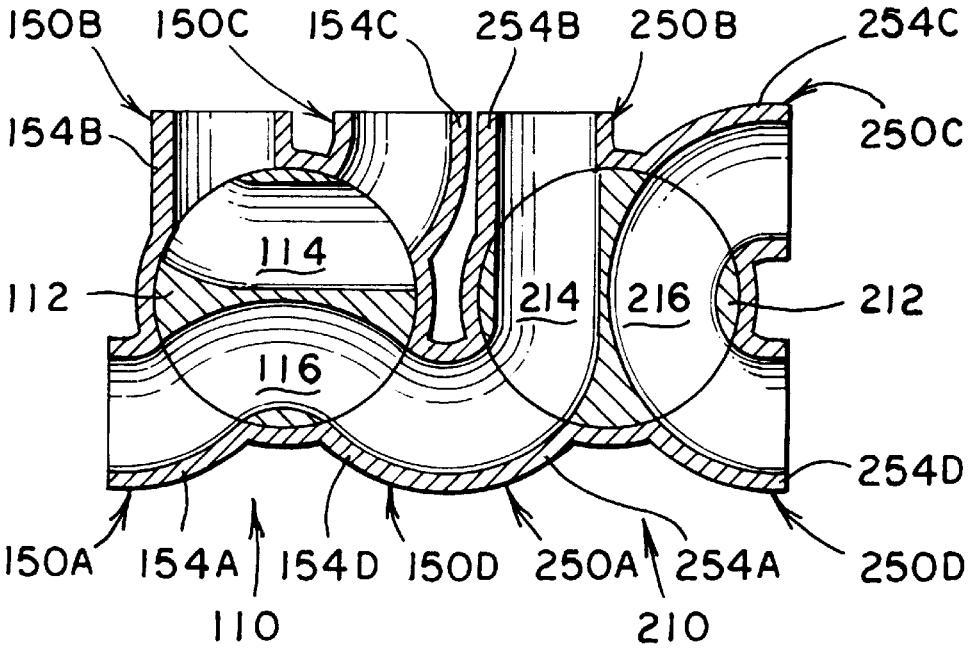
FIG. 5 is a cross-sectional side view of the valves in FIG. 4, the first valve being in an unactuated position, the second valve being in an actuated position.
Figure 6:
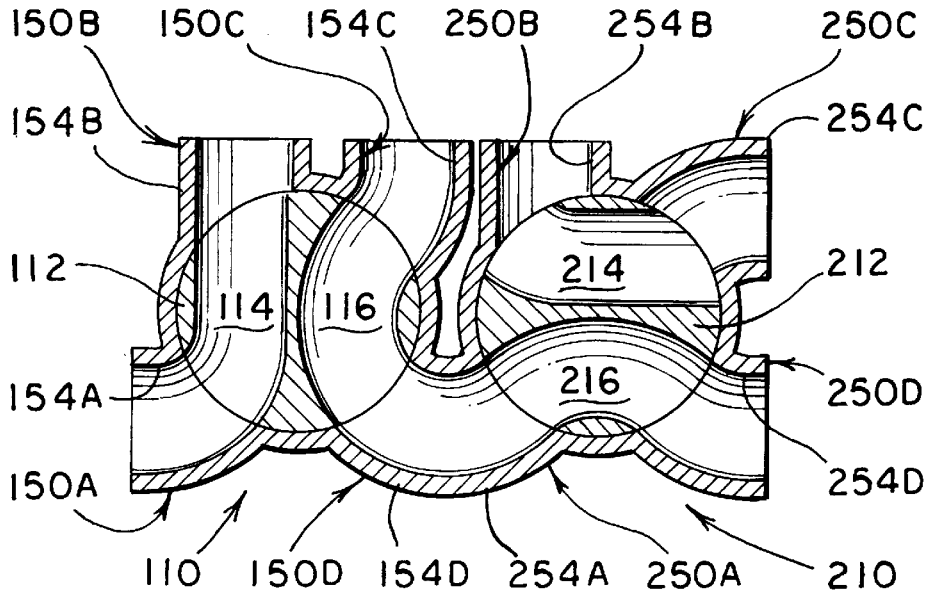
FIG. 6 is a cross-sectional side view of the valves in FIG. 4, the first valve being in an actuated position, the second valve being in an unactuated position.

When the musician desires to add one loop into the soundpath, the musician may either actuate the first valve 110 or the second valve 210, as shown in FIGS. 5 and 6. The instrument designer may vary the length of the additional loops such that the first valve 110 may add a long loop when actuated and the second valve 210 may add a short loop in the actuated position. It is noted that because the second sidewalls 154B and 254B are straight, the actuated positions of valves 110 and 210 have less acoustic impedance than those valves having all curved sidewalls. In either position, the sound moving through valves 110 and 210 is only subjected to two 90 degree turns and a single approximately 45 degree turn.

Figure 7:
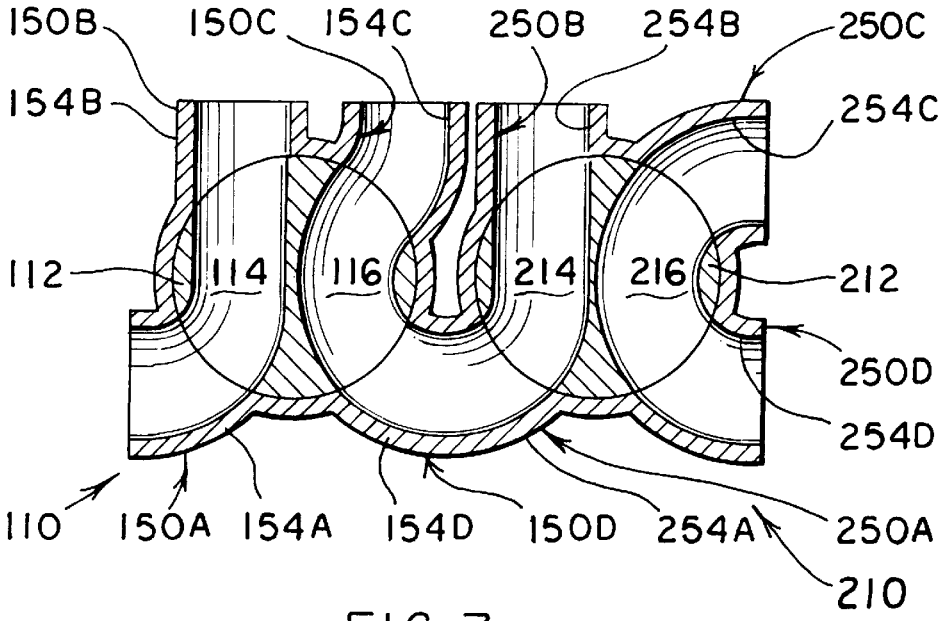
FIG. 7 is a cross-sectional side view of the valves in FIG. 4, the rotors of both valves being in the actuated position.

If the musician desires to add both loops to the soundpath, the musician actuates both valves 110 and 210 as shown in FIG. 7. In this position, the longest possible soundpath for the two valves 110 and 210 is achieved. Thus, the sound experiences two 90 degree turns and two approximately 45 degree turns in the confines of valves 110 and 210. The first 45 degree turn occurs as the sound passes through the first duct 114 of the first valve 110. The sound is then subjected to the various turns that may occur in the additional length of tubing (not shown). When the sound returns to the first valve 110, the sound is subjected to the first 90 degree turn in the second duct 116 of the first valve 110. After the sound leaves the second duct 116, the sound passes through tube connectors 150D and 250A that connect valves 110 and 210. Tube connectors 150D and 250A are curved in the example depicted and add an additional turn to the overall soundpath. This additional turn, however, is not inside the body of the valves 110 and 210. The sound then experiences the second 45 degree turn in the first duct 214 of the second valve 210 and the second 90 degree turn in the second duct 216 of the second valve 210.

Figure 8:
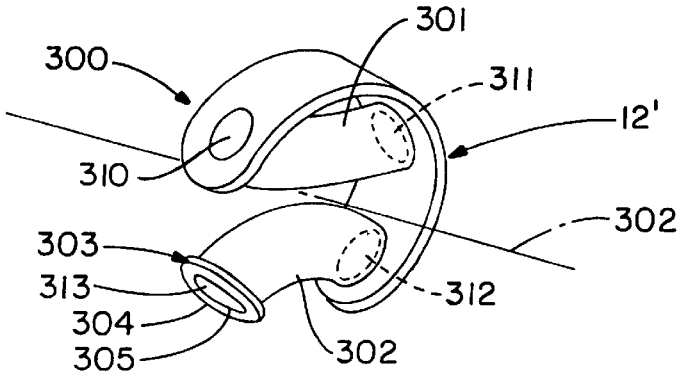
FIG. 8 is an isometrical view of another embodiment of the rotor of the rotary valve according to the present invention.
Figure 9:
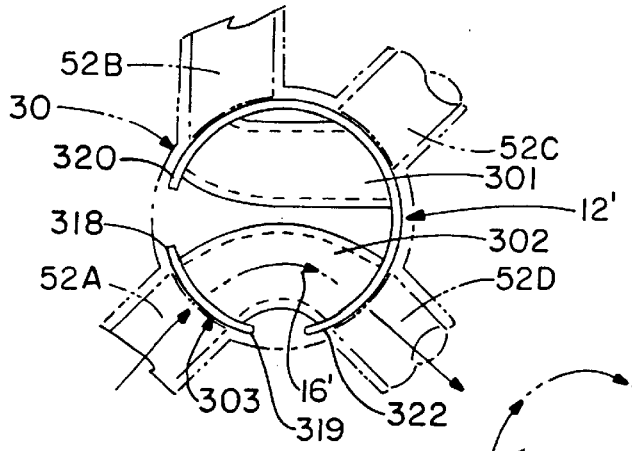
FIG. 9 is a plan view of another embodiment of the rotary value according to the present invention, the valve being depicted in the unactuated position.
Figure 10:
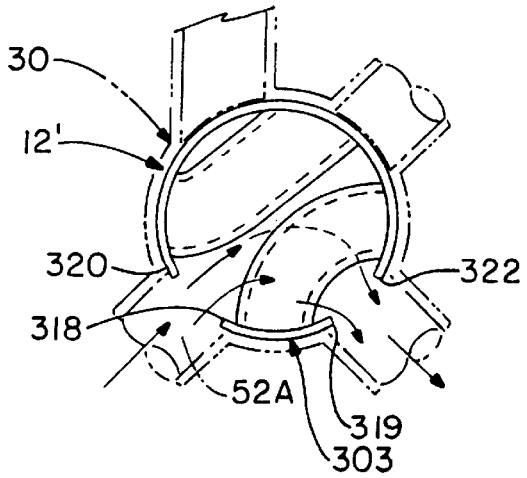
FIG. 10 is a plan view of another embodiment of the rotary valve according to the present invention, the valve being depicted in an intermediate position.
Figure 11:
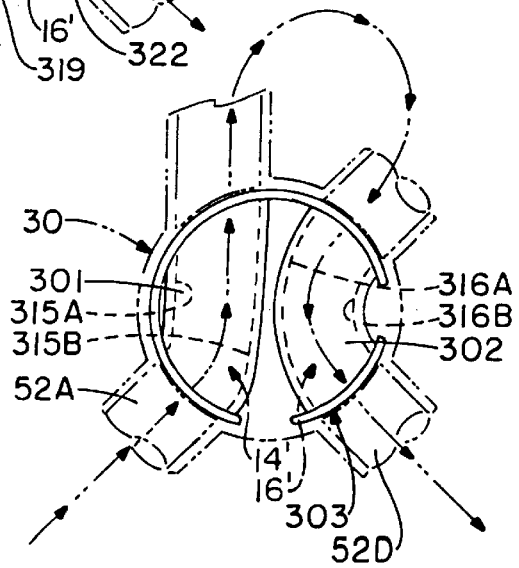
FIG. 11 is a plan view of another embodiment of the rotary valve according to the present invention, the valve being in an actuated position.

A second embodiment of the present invention is shown in FIGS. 8–12. The rotor of this embodiment overcomes potential problems associated with the first rotor that could be occasioned if air flow blockage occurs when the rotor is switched from the actuated position to the unactuated position or vice versa. As with the first embodiment, the rotor of this embodiment sits within casing 30, as shown in FIGS. 9–11.

As shown in FIG. 8, rotor 12' includes a partial circumferential member 300 having a first aperture 310, as well as second and third apertures, 311 and 312 respectively. Rotor 12' further includes a first tube member 301 connected at its ends to circumferential member 300 between first aperture 310 and second aperture 311. This first tube member 301 is mechanically bonded to the partial circumferential member 300 in a fashion so that there is a tight fluid communication between first aperture 310 and second aperture 311.

Rotor 12' further includes a second tube member 302 mechanically bonded at one end to circumferential member 300 at third aperture 312 in a fashion so that there is tight fluid communication between third aperture 312 and second tube 302. At the other end of the second tube 302 is an aperture 313 and a collar 303, which preferably is mechanically bonded. This collar has an arcuate surface that is positioned on the same circumference as circumferential member 300. Therefore, as shown in FIGS. 9–11, collar 303 will fit snugly within the circumference of the casing 30. As with the previous embodiments, first and second tubes 301 and 302 have constant circular cross-sections.

With respect to FIG. 9, it should be understood that partial circumferential member 300 does not extend the entire circumference of a circle and therefore has a first end 320 and a second end 322. The collar 303 is positioned between first end 320 and second end 322, and circumferentially spaced gaps should exist between first end 320 and the top end 318 of collar 303, and between the second end 322 and the collar bottom end 319 of 303. These gaps should allow the passage of air to flow freely therethrough, around the outside of tube 302 within the casing, when the rotor is passing through an intermediate orientation as shown in FIG. 10, where the passage of air is shown by arrows. Also, it is preferred that these gaps be as large as possible. The size of the gap is limited by the size of the collar 303 and the perimeter or partial circumference of partial circumferential member 300, and more specifically ends 320 and 322 of partial circumferential member 300. Ends 320 and 322 are, in turn, limited by the position of first and third apertures, 310 and 312 respectively, because the apertures are positioned to communicate with the external tube connectors 52A and 52B when in the actuated position as shown in FIG. 11. Therefore, it should be understood that the size of the gaps cannot arbitrarily be enlarged. Moreover, the collar lip, which is defined by collar-outer circumference 304 and collar-inner circumference 305, as shown in FIG. 8, must be sufficiently large to form a fluid tight communication with external tube connector 52A when in the unactuated position as shown in FIG. 9, and external tube connector 52D when in the actuated position as shown in FIG. 11. Likewise, the partial lips on the partial circumferential member, the first being defined by the first end 320 and the first aperture 310, and the second defined by the second end 322 and the third aperture 312, must be sufficiently large to form fluid tight connections with external tube connector 52D when in the unactuated position as shown in FIG. 9, and external tube connectors 56A and 56B when in the actuated position as shown in FIG. 11. Accordingly, first aperture 310 should be positioned near first end 320 of the partial circumferential member 300, and third aperture 312 should be positioned near the second end 321 of partial circumferential member 300. In a preferred embodiment, the position of first aperture 310 and second aperture 311 will be such that the partial lips at the first and second ends of the partial circumferential member will be as small as possible while providing adequate sealing to provide a fluid tight communication with the external tube connectors 52A and 52B in the actuated position as shown in FIG. 11 and as noted above. Similarly, the partial lips around the third aperture 312 and the lip of the collar 303 will be as small as possible while still providing adequate sealing to provide a fluid tight communication with the external tube connectors 52A and 52B in the unactuated position as shown in FIG. 9, and between 52C and 52D when in the actuated position as shown in FIG. 11. Preferably, collar lip and partial lip on the partial circumferential member should have a width of at least about 1.5 mm, more preferably at least about 2 mm, even more preferably at least about 2.5 mm.

As with the first embodiment of this invention, and as specifically shown in FIG. 11, first tube 301 forms a first duct 14', and second tube 302 forms a second duct 16'. Both of these ducts are intact ducts, i.e., ducts 14' and 16' are defined by interiors of constant circular cross-section. The inner diameter of first tube 301 is defined by inner walls 315A and 315B, and the inner diameter of second tube 302 is defined by inner walls 316A and 316B. When in the unactuated position, as shown in FIG. 9, the inner diameter of second tube 302 will form a fluid connection with tube connectors 52A and 52D such that sound waves entering the second tube 302 from connector 52A can pass therethrough and out to connector 562D and experience a constant circular cross-section therethrough. On the other hand, when the rotor is in the actuated position, as shown in FIG. 11, the inner diameter of first tube 301 will form a fluid connection with the inner diameter of tube connectors 52A and 52B such that sound waves passing therethrough will experience a constant circular cross-section. Likewise, when in this actuated position, the inner diameter of the second tube 302 will form a fluid connection with the inner diameter of tube connectors 52C and 52D such that sound waves passing therethrough will experience a constant circular cross-section.

It is preferred that the first tube 301 and second tube 302 be angled or curved in a similar fashion to ducts 14 and 16 of the first embodiment herein. In other words, first tube 301 should be configured at an angle of approximately 45 degrees so that the soundpath between connectors 52A and 52B, as shown in FIG. 11, will turn through an angle of approximately 45 degrees when in the actuated position. When in the unactuated position, as shown in FIG. 9, no sound waves travel through first tube 301 and therefore a fluid tight connection between 52B and 52C is not necessary. The second tube 302 should be configured at an angle of substantially 90 degrees so that when in the unactuated position, as shown in FIG. 9, the soundpath between 52A and 52D will turn through an angle of substantially 90 degrees; when in the actuated position, as shown in FIG. 11, the soundpath through second tube 302 between connectors 52C and 52D will likewise turn through the substantially 90 degree angle.

It should be appreciated that the rotor of this embodiment will advantageously overcome problems associated with air-flow blockage that occurs when the rotor is being switched from the actuated position to the unactuated position or vice versa. This problem is overcome as a result of the gap that exists between end 320 of partial circumferential member 300 and upper end 318 of collar 303, as well as the gap that exists between lower end 322 of the partial circumferential member 300 and lower end 319 of collar 303. Because of these gaps, air entering through connector 52A and passing through the gap defined between 320 and 318 will be able to pass through the gap defined by 322 and 319, and exit the valve through connector 52D, passing around the outside of tube 302 within casing 30, as shown by the arrows in FIG. 10. It can be seen from the arrows in FIGS. 9, 10 and 11 that, no matter whether the rotor is in the unactuated (FIG. 9), actuated (FIG. 11) or intermediate (FIG. 10) orientation, there is always a continuous flow of air in through external tube connector 52A and out through external tube connector 52D. There is thus no interruption of the air stream when an instrument is being played.

Additionally, the rotor 12' of this embodiment advantageously has reduced friction within casing 30 due to the fact that member 300 is only a partial circumferential member as opposed to a full circumferential member, and therefore the surface area in sliding contact between rotor 12' and casing 30 is minimized. As a result, rotor 12' will rotate more efficiently within casing 30. This in turn produces a faster and more precise action when switching from the unactuated to the actuated position and vice versa.

Turning now to FIGS. 12 and 12A, the rotor of this embodiment should also include at least one support member 15. The support member is advantageously employed to support and maintain the position of second tube 302 and to provide an axis point 36 around which the rotor can rotate. For example, as shown in FIG. 12, support member 15 is attached or mechanically bonded to partial circumferential member 300 and to collar 303. Although one support member is shown in FIG. 12, it should be understood that a second support member can exist on the opposite side of the rotor. It should also be understood that although a four-armed configuration is shown in FIG. 12, those skilled in the art will be able to employ a wide variety of shapes and configurations for purposes of reinforcing the structure and maintaining the proper spacing of the components. A second example is shown in FIG. 12A. Here, a support member is attached to first tube 301 and second tube 302. Again, although one support member is shown in this figure, it should be understood that a second support member can exist on the opposite side of the rotor. As noted above, FIGS. 12 and 12A show an axis point or member 36 within support member 15, as specifically shown by a pinhole 36, into which a pin can be mechanically bonded so that the rotor may be rotated. Also, pins or the like can extend from the support member to provide an axis point around which the rotor can be rotated. It should also be appreciated that axis point 36, such as by a pin member for example, can be attached directly to tubes 301 and 302 and thereby achieve the same goal of providing an axis point without necessarily relying on a support member.

In yet another embodiment, partial circumferential member 300 is scalloped as shown in FIG. 13. Here, partial circumferential member 300 is modified with at least one scallop 360, but preferably contains multiple scallops 361, 362, and 363. In general, and according to this embodiment, partial circumferential member 300 is reduced in width at as many locations as possible without compromising the strength necessary to maintain tubes 301 and 302 in their appropriate positions and without compromising the tight fluid communication that is established with tubes 301 and 302 and the apertures with which they communicate. Advantageously, the scalloping of this embodiment further reduces friction between the rotor and the casing and thereby provides for faster rotor rotation.

In yet another embodiment of this invention, the rotor includes a solid body, in a similar fashion to that of the first embodiment, and the body is altered to provide an air passage that will allow the release of air when the rotor is being switched from the actuated to the unactuated position. This embodiment is best understood with reference to FIGS. 14, 15, and 16.

Figure 16:
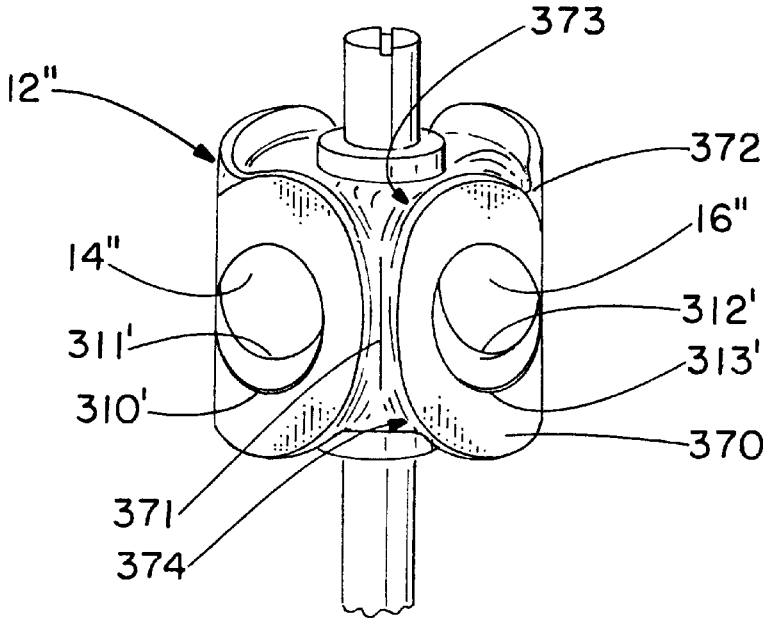
FIG. 16 is an isometric view of the embodiment shown in FIGS. 14 and 15.

As shown in FIG. 16, the rotor 12" is generally cylindrical in shape. The cylindrical sidewall includes four apertures. All four apertures are shown, with the first and fourth apertures, 310' and 313' respectively, facing the viewer, and the second and third apertures, 311' and 312' respectively, being partially visible through first aperture 310' and second aperture 313'. These apertures provide an opening in the sidewall 370 of rotor 12' and complete first duct 14" and second duct 16" within rotor 12". Ducts 14" and 16" are best understood with reference to FIG. 14. As with the previous embodiments of this invention, the first duct 14" has a constant circular cross-section and provides a soundpath that is an angle of approximately 45 degrees. And, second duct 16" has a constant circular cross-section that provides a soundpath that is an angle of substantially 90 degrees.

The air passageway that will allow the release of air through the rotor as the rotor is switched between the actuated and unactuated position is provided by two axial recesses in the rotor body and at least one channel or slot that allows for the unobstructed passage of air between the two axial recesses. With reference first to FIG. 14, first axial recess 371 is shown positioned between first 310' and fourth 313' apertures, and likewise medially positioned between first 14" and second 16" ducts. Also shown is a second axial recess 372 positioned between fourth 313' and third 312' aperture. The axial recesses should be as large as possible but should not compromise the integrity of either the first 14" or second 16" ducts or their respective lips as discussed below.

The air passageway is completed by a channel or slot 373 that provides an unobstructed passageway for air to travel between the first 371 and second 372 recesses outside of the duct 16" but inside the casing. The channel 373 is positioned above and around the second duct 16", and is preferably as large as possible without compromising the integrity of the second duct 16". While only one channel or slot is required to provide this passageway between the first 371 and second 372 recesses, it is preferred that the rotor include two channels or slots. The other channel, of course, would be positioned opposite the first channel 373 below the third aperture 313'. The axial recesses, such as recess 371, may be better understood with reference to FIGS. 15 and 16. As is shown in these figures, it is preferred that the axial recesses increase in width at the top and bottom of the recess. Portions of upper channel 373 and lower channel 374 can be seen in FIG. 15, and upper channel 373 is more fully shown in FIG. 16.

Also, although the size of the channel 373 should be as large as possible, the channel should not compromise the surface of the cylindrical sidewall 375 around the first 310', third 312', and fourth 313' apertures. As those skilled in the art will appreciate, a sufficient circumferential surface, or lip, must be maintained around each of the apertures so as to allow proper fluid tight connection with the casing 30 when the rotor is in the actuated or unactuated position.

The rotor of this embodiment can be formed in several ways as should be appreciated by those skilled in the art. For example, the rotor can be formed by casting within a dye that includes the axial recesses and channels. Or, a rotor can be dye casted and the axial recesses, channels, scallops, and the like can be machined or scavenged away.

Typically, the rotors of this invention are made of solid brass. Those skilled in the art, however, will appreciate that a variety of other materials can be employed to make these rotors. For example, polymeric materials, ceramics, stainless steel, and anodized aluminum can be employed. Additionally, it should be understood that the various components of the rotor can be made of different materials. Still further, the materials that are employed in making the rotor of this invention can be surface treated. For example, various components can be coated with nickel plating or similar hard finish.

While only a preferred embodiment of the present invention is disclosed, it is to be clearly understood that the same is susceptible to numerous modifications apparent to one skilled in the art. Therefore, the scope of the present invention is not to be limited to the details shown and described but is intended to include all changes and modifications which come within the scope of the appended claims and their equivalents.

As should now be apparent, the present invention not only provides a rotary valve capable of providing constant diameter, low curvature soundpaths, but also demonstrates that the other objects of the invention are likewise accomplished.

I claim:

1. A rotor for a brass wind instrument comprising:

a partially circumferential member having first, second and third apertures therein;

a first tube being connected between said first and second apertures;

a second tube being connected at one end to said circumferential member and having an arcuate collar at its other end, said collar positioned on the same circumference as said circumferential member.

2. A rotor, as set forth in claim 1, where said first tube bends at an angle of approximately 45 degrees.

3. A rotor, as set forth in claim 2, where said second tube bends at an angle of substantially 90 degrees.

4. A rotor, as set forth in claim 1, further including a support member that is attached to said first and said second tubes.

5. A rotor, as set forth in claim 1, further including a support member that is attached to said circumferential member and to said collar.

6. A rotor, as set forth in claim 1, where said partially circumferential member has circumferentially spaced first and second ends.

7. A rotor, as set forth in claim 6, where said first aperture is near said first end of said circumferential member and where said third aperture is near the second end of said partial circumferential member.

8. A rotor, as set forth in claim 1, where said support member includes an axis member around which the rotary valve can rotate.

9. A rotor, as set forth in claim 1, where said partially circumferential member includes at least one scallop.

10. A rotor, as set forth in claim 1, where said first and second tubes have a constant circular cross-section.

11. A rotary valve for a brass wind instruments comprising:

a casing;

a rotor rotatably disposed in said casing; said rotor comprising a partially circumferential member having first, second and third apertures therein;

a first tube being connected between said first and second apertures;

a second tube being connected at one end to said circumferential member and having an arcuate collar at its other end, said collar positioned on the same circumference as said circumferential member.

12. A rotary valve, as set forth in claim 11, where said partially circumferential member includes at least one scallop.

13. A rotary valve, as set forth in claim 11, where said first and second tubes have a constant circular cross-section.

14. A rotor for a brass wind instrument comprising:

a rotor body having a generally cylindrical shape and having a circular sidewall with upper and lower ends;

first and second ducts within said rotor body;

first, second, third and fourth apertures disposed around said sidewall and providing said ducts an opening through said sidewall, said first and second apertures being in fluid communication with one another through said first duct and said third and fourth apertures being in fluid communication with one another through said second duct;

a first axial recess positioned between said first and fourth apertures;

a second axial recess positioned between said third and fourth apertures; and a channel that allows the passage of air between said first and second axial recesses, said channel being positioned around said second duct.

15. A rotor, as set forth in claim 14, where said first duct bends at an angle of approximately 45 degrees.

16. A rotor, as set forth in claim 15, where said second duct bends at an angle of substantially 90 degrees.

17. A rotor, as set forth in claim 14, further comprising a second channel that allows the passage of air between said first and second axial recesses, said second channel being positioned around said second duct.

18. A rotor, as set forth in claim 14, where said first and second ducts have a constant circular cross-section.

* * * * *